US008967972B2

(12) United States Patent
Brandl et al.

(10) Patent No.: US 8,967,972 B2
(45) Date of Patent: Mar. 3, 2015

(54) LIGHT WEIGHT SHROUD FIN FOR A ROTOR BLADE

(71) Applicant: ALSTOM Technology Ltd, Baden (CH)

(72) Inventors: Herbert Brandl, Waldshut-Tiengen (DE); Igor Tsypkakyin, Turgi (CH); Philipp Indlekofer, Klettgau-Erzingen (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 13/668,136

(22) Filed: Nov. 2, 2012

(65) Prior Publication Data

US 2013/0058788 A1 Mar. 7, 2013

Related U.S. Application Data

(63) Continuation of application No. PCT/EP2011/055347, filed on Apr. 6, 2011.

(30) Foreign Application Priority Data

May 5, 2010 (EP) ..... 10162021

(51) Int. Cl.
*F01D 5/08* (2006.01)
*F01D 5/02* (2006.01)
(Continued)

(52) U.S. Cl.
CPC ..... *F01D 5/225* (2013.01); *F01D 5/187* (2013.01)
USPC ..... 416/189; 416/191; 416/192; 416/212 R; 415/173.1; 415/173.4; 415/173.6; 415/174.4

(58) Field of Classification Search
USPC ..... 416/191, 189, 212 R, 192; 415/173.1, 415/173.4, 173.6, 174.4
See application file for complete search history.

(56) References Cited

U.S. PATENT DOCUMENTS 3,377,050 A * 4/1968 Guy ..... 416/191
2008/0025841 A1* 1/2008 Norton et al. ..... 416/191
2008/0279695 A1* 11/2008 Abdel-Messeh et al. ... 416/97 R

FOREIGN PATENT DOCUMENTS

CN 1406312 A 3/2003
DE 19904229 A1 8/2000
(Continued)

OTHER PUBLICATIONS

English translation of the First Office Action and Search issued on Jun. 4, 2014 in corresponding Chinese Patent Application No. 2011800334524.
(Continued)

*Primary Examiner* — Igor Kershteyn
(74) *Attorney, Agent, or Firm* — Buchanan Ingersoll & Rooney PC

(57) ABSTRACT

A turbine blade is provided and includes a tip end carrying a shroud and at least one fin, which extends radially away from the shroud. The fin includes a first sidewall and a second sidewall, which are spaced apart, arranged parallel to each other, and are connected to the shroud, and a cutting edge, which is connected to the first and second sidewalls. The cutting edge thereby creates a hollow space between the sidewalls, the shroud, and the cutting edge, and further extends radially away from the first and second sidewalls. Also provided is a method of manufacturing the blade by casting the blade as single piece with the hollow fin or by forging the blade; and machining the fin to create the first and second sidewalls and cutting edge thereby opening the hollow space between said sidewalls and the cutting edge.

11 Claims, 5 Drawing Sheets

(51) Int. Cl.

| | |
|---|---|
| ***B23P 15/02*** | (2006.01) |
| ***F01D 5/22*** | (2006.01) |
| ***F01D 5/18*** | (2006.01) |

(56) References Cited

FOREIGN PATENT DOCUMENTS

| | | | |
|---|---|---|---|
| DE | 19944923 | A1 | 3/2001 |
| GB | 2434842 | A | 8/2007 |

OTHER PUBLICATIONS

Office Action issued May 29, 2014 in corresponding Russian Patent Application No. 2012152058, and an English translation thereof.

"Structure and design for the aircraft gas turbine engines", Edited by D.V. Khronin, 1989, pp. 212-219, and an English translation of the relevant part.

* cited by examiner

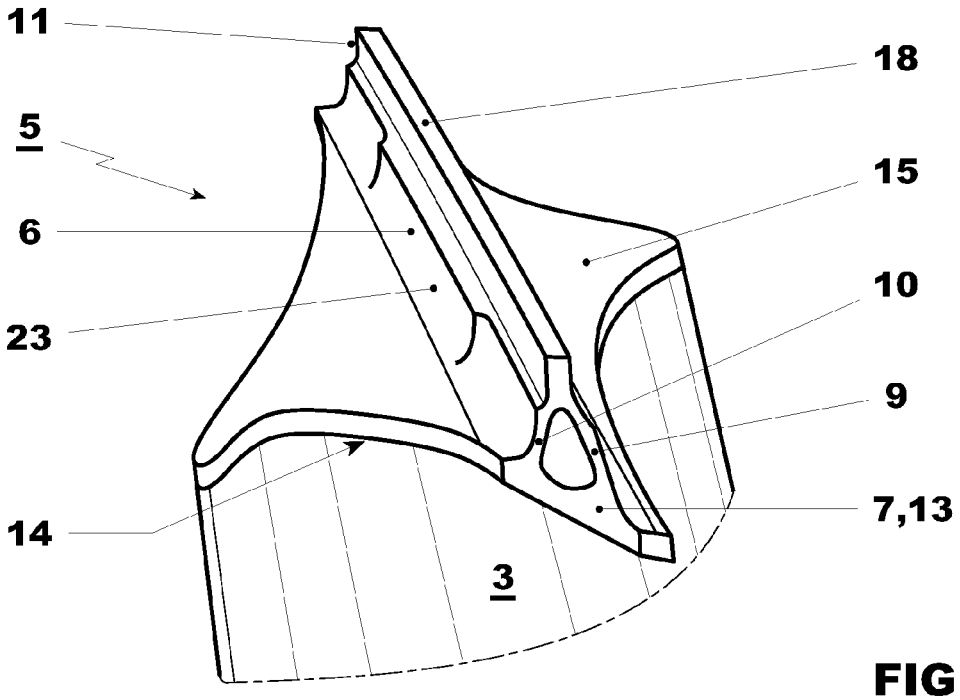
FIG. 3
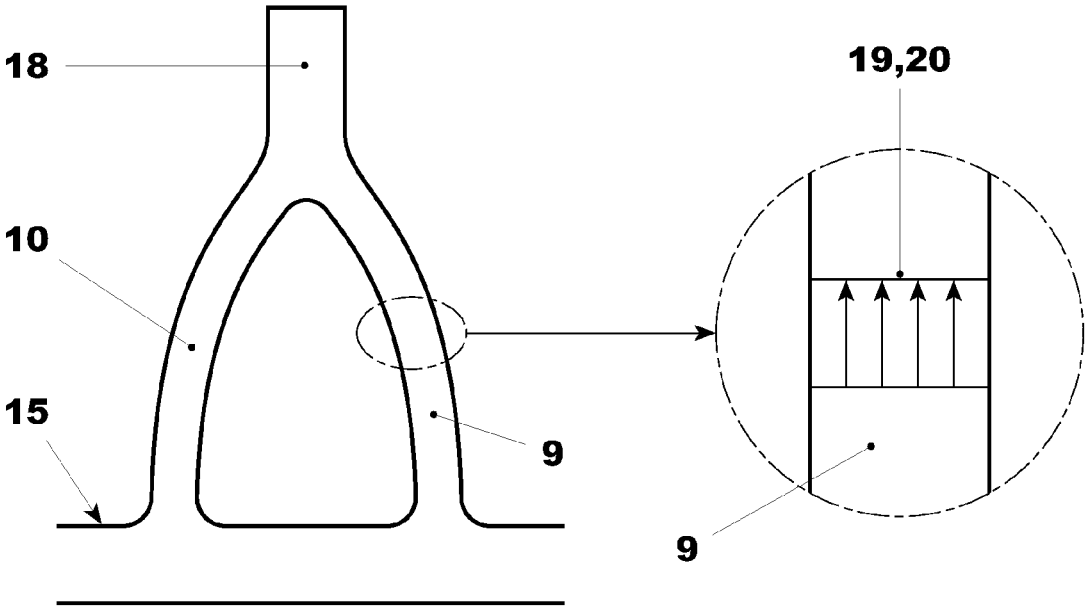
FIG. 3a
FIG. 3b

LIGHT WEIGHT SHROUD FIN FOR A ROTOR BLADE

INCORPORATION BY REFERENCE

The following documents are incorporated herein by reference as if fully set forth: International Patent Application No. PCT/EP2011/055347, filed Apr. 6, 2011—and—European Patent Application No. 10162021.9, filed May 5, 2010.

FIELD OF INVENTION

The present invention refers to a rotor blade with a shroud for a turbo machine, especially a turbine.

BACKGROUND

Turbine stages, especially end stages of conventional turbo machine have long rotor blades. The last stage rotor blades have interlocking shrouds to improve in particular vibrational behavior. Essentially, a shroud has thickness and has sides, which are cut to create an interlocking configuration when adjacent rotor blades are present.

The purpose of a shroud is to prevent leakage over the blade tip, improve efficiency of the turbine and improve the dynamic and vibration qualities of the rotor blade. The interlocking of shrouds takes place along two bearing faces. The interlocking of shrouds at bearing faces leads to dampening of vibrations. An additional feature is provided on the tip of a rotor blade shroud is a fin. Depending upon the size of the blade shroud, one or more fin may be present.

The fins have a sealing function to reduce secondary flow across the blade tips. Bending stiffness required to withstand centrifugal loads, which are generated during the movements of blades, is provided by the fin height.

Presently, shrouds for last stage rotating blades are essentially solid. The shroud is an additional load to the blade and the rotor. The airfoil and root of the blade carry the weight of the shroud. It has significant impact on cross sectional area of the airfoil and consequently on the weight of airfoil and root. During operation, as blades rotate at high speeds on a rotor about the turbine axis the blades are held in the rotor by the blade root, which mechanically engages in the rotor. As the blades rotate, the centrifugal forces cause the blade to pull in radial direction and to load the rotor.

The amount of loading on the rotor and hence the root, which holds the blade in the rotor is a function of the blade weight. A heavy blade leads to more stresses on the interface between blade root and rotor, and to high total radial forces on the rotor. The weight of shrouds increases the radial force, which approaches the rotor limit. Therefore, it poses important design limitations to the performance of a turbine and can reduce the overall life of the root and rotor.

Turbo machines, especially steam turbines, have long blades to increase the exhaust annulus area for performance reasons. The annulus area is increased to allow high mass flows. Long blades are used for large annulus areas, which result in higher weight for blades. Current designs typically have fully shrouded tips of blades with fins for improved vibration control and to reduce the tip leakage losses.

To reduce leakages during turbine operation a honeycomb is typically arranged opposite to the fin. During operation the fin cuts into the honeycomb.

The efficiency of modern turbines and compressors depends upon a tight seal between the rotating components (blades) and the stationary component. This seal is established by allowing the fins of blades to cut (abrade) a groove in an abradable seal material, which prevents a substantial volume of air from leaking past the blade tip. Typically the seal materials are honeycombs seals or have sintered metallic particles and brazed in place. To assure a safe operation of the turbine, the fin has to be sufficiently strong to cut into the seal material under operating conditions.

Further, the fin has to be sufficiently strong to fulfill its dampening function when the fins of adjacent blades bear on each other during operation.

To avoid creep of the fins during hot operating conditions, and to increase the lifetime cooling of fins has been suggested in DE19904229. It was further noted, that the weight of the fins could be reduced by drilling holes into the fin. However, the achievable weight reduction by drilled holes is limited. Further, holes can be detrimental to the lifetime of the blade, as they have a notching effect, which can lead to stress concentration and consequently to high local maxima in the stress distribution in the fin.

SUMMARY

The present disclosure is directed to a turbine blade including a tip end carrying a shroud and at least one fin, which extends radially away from the shroud. The fin includes a first sidewall and a second sidewall, which are spaced apart, arranged parallel to each other, and are connected to the shroud, and a cutting edge, which is connected to the first and second sidewalls. The cutting edge thereby creates a hollow space between the sidewalls, the shroud, and the cutting edge, and further extends radially away from the first and second sidewalls.

The present disclosure is also directed to a method of manufacturing the blade by casting the blade as single piece with the hollow fin or by forging the blade; and machining the fin to create the first and second sidewalls and cutting edge thereby opening the hollow space between said sidewalls and the cutting edge.

BRIEF DESCRIPTION OF THE DRAWINGS

The following detailed description of the preferred embodiment of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Introduction to the Embodiments

Figure 1:
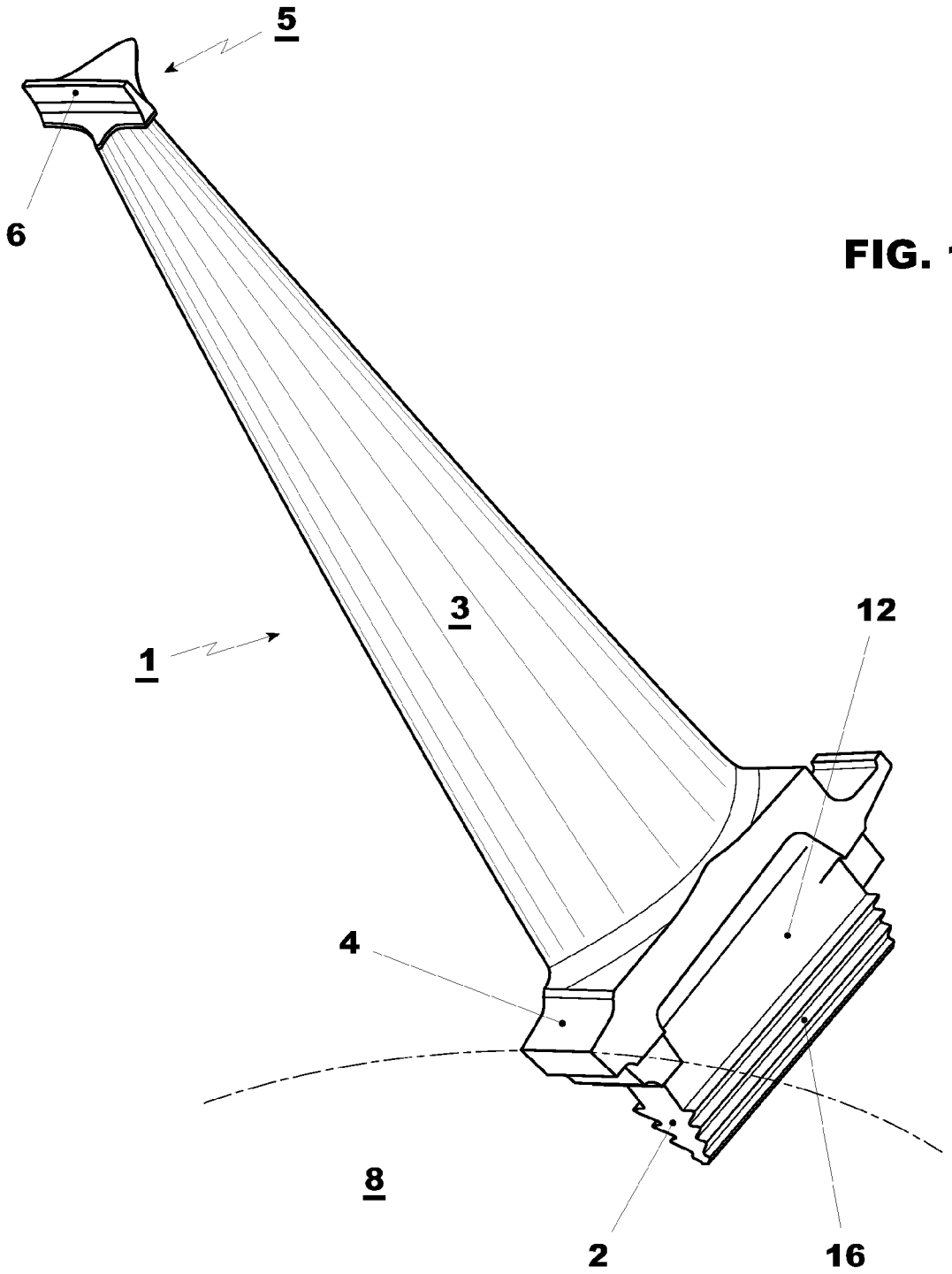
FIG. 1 schematically shows an embodiment of the blade in a perspective view having a shroud and fin, FIG. 2 schematically shows a perspective view of a fin with a first and a second sidewall, and a cutting edge, FIGS. 2*a*, and 2*b* schematically show a cross-section of a blade tip comprising a fin with a first and a second sidewall, and a cutting edge, as well as the tensile stress distribution in one sidewall, FIG. 3 schematically shows a perspective view of a blade tip comprising a fin with curved first and second sidewall of the fin, and a cutting edge, FIGS. 3*a*, and 3*b* schematically show a cross-section of a fin with curved first and second sidewall, and a cutting edge, as well as the tensile stress distribution in one sidewall, FIG. 4 schematically shows a third embodiment of the blade, FIG. 5 schematically shows a perspective view of two interlocking blade tips comprising interlocking fins, FIG. 6 schematically shows a perspective view of a blade tip comprising a fin with interlocking plates at the fin ends, FIG. 7 schematically shows a side view of a blade tip comprising a fin with interlocking plates at the fin ends.

It is therefore an object of the present invention to provide an improved lighter rotating blade with reduced overall blade mass, reducing the radial forces of the blades on the rotor, without compromising the strength or lifetime of the blade.

Another object of the present invention is to provide an improved lighter rotating blade that does not compromise shroud-bending stresses.

Yet another object of the present invention is to provide an improved lighter rotating blade, which fulfills the interlocking task for shrouds.

These and other objects of the present invention are solved by an improved rotating turbine blade. A rotating blade typically comprises a root section, a platform section connected to the root, an airfoil extending from the platform, the airfoil having a platform end connecting to the platform, and a tip end opposite said platform end. A shrouded blade further comprises a shroud extending outward from the tip end and attached thereto, and at least one fin extending radially away from the outer surface.

According to a first embodiment of the invention, the fin comprises a first sidewall, and a second sidewall, which are spaced apart, arranged parallel to each other, and are connected to the shroud, and a cutting edge, which is connected to the first and second sidewall, and is thereby creating a hollow space between the sidewalls, the shroud, and the cutting edge. The cutting edge is further extending radially away from the first and second sidewall.

In one embodiment, the first and second sidewalls are spaced apart at the connection to the shroud, and are contoured to merge together at the end, which is radially away from shroud.

In a further embodiment, the first and second sidewalls are contoured to seamlessly connect to cutting edge.

In one embodiment, the hollowness is realized such that resulting centrifugal forces are due to the mass of the fin and/or shroud are aligned with the neutral axis of the blade and do not result in any bending moment on the blade when the turbine is rotating.

In another more specific embodiment, the hollowness is realized along the neutral axis of the fin. In yet another embodiment, the hollowness is realized symmetrically along the neutral axis of the fin.

In one embodiment, the hollow fin comprises two thin sidewalls connected to the shroud at the inner radius and connected to a solid cutting edge at the outer radius. The cutting edge is a solid metal body configured to cut into the honeycomb fixed to the stator walls surrounding the turbine stage when installed in the turbine. The combination of honeycomb and fin form a honeycomb seal.

In another embodiment, the hollow fin essentially is a v-shaped. The v is standing upside down on the shroud, pointing away from the shroud. The v-shaped fin standing on the shroud and connected to shroud at the end of the two legs of the v-shaped fin. The legs of the v-shaped fin are the sidewalls of the fin. The pointed end can be reinforced and extend in radial direction to form a cutting edge, which is sufficiently strong to cut into a honeycomb fixed to stator walls surrounding the turbine stage in order to form a honeycomb seal.

Further, configuring the hollow fin to allow cooling through the hollow fin is proposed. Cooled fins can for example be used in gas turbine applications.

A method for manufacturing an improved lighter rotating blade comprises the step of casting the blade as single piece with a casted hollow fin.

Yet another method for manufacturing an improved lighter rotating blade comprises the steps of forging the blade, and removing the material to make said fin hollow.

The hollow and light weight fins of the present invention provide sufficient second moment of inertia without compromising stiffness in circumferential direction (bending and torsion), thus assuring good shroud interlocking.

To obtain hollow shrouds, excess material can be removed from the fin. With such hollow and lightweight fins, weight reduction is achieved. Weight reduction is not only realized in the fin itself but also in the airfoil and root because these have to carry only the reduced fin weight. This leads to lighter blades and allows the design of longer blades, which in turn lead to increased flow areas and increased turbine power and efficiency.

DETAILED DESCRIPTION

Further features and advantages of the invention will become clear from the following description of embodiments in the conjunction with the accompanying drawings.

In FIG. 1, reference numeral 1 denotes a blade having a root section 2 that comprises a neck area 12, outward from the root section 2. The root section 2 has machined surfaces 16, which are engageable into a matching profile of a rotor 8 such that the blade 1 is fixed on a turbine rotor 8 under centrifugal load. A platform section 4 emerges outwardly from the blade root 2 and neck area 12 and is connected to root section 2. An airfoil 3 extends outwardly from the platform 4. The airfoil 3 has an end connected to platform 4 and a tip end. A shroud 5 is connected to the tip end and extends outward from the tip end. The shroud comprises at least one fin 6.

Figure 2:
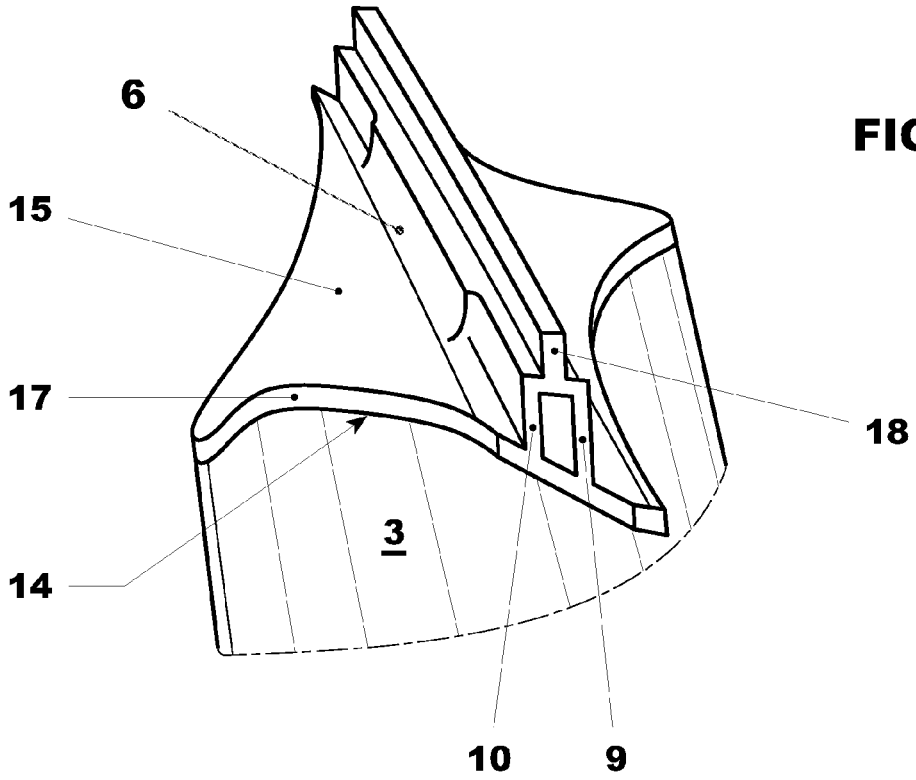

FIG. 2 shows the shroud 5 extending outward from the tip end of the airfoil 3. The shroud 5 comprises an inner surface 14 that is fixed to the tip end of the airfoil 3 and an outer surface 15 covering the inner surface 14. A sidewall 17 connecting the inner 14 and outer 15 surfaces is generally perpendicular to both surfaces.

The blade also comprises at least one fin 6, which extends radially away from the shroud 5. The fin 6 itself comprises a first sidewall 9, and a second sidewall 10, which are spaced apart, arranged parallel to each other, and are connected to the shroud 5. Further, the fin comprises a cutting edge 18, which is connected to the first and second sidewall 9, 10, and is thereby creating a hollow space between the sidewalls 9, 10, the shroud 5, and the cutting edge 18. The cutting edge 18 is further extending radially away from the first and second sidewall 9, 10.

Figure 2A:
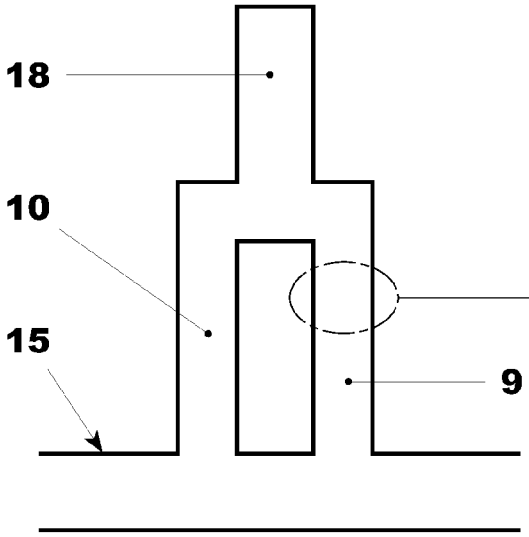
Figure 2B:
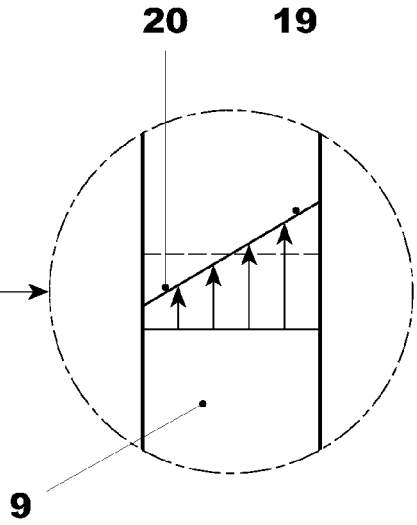

FIG. 2*a* schematically shows a cross-section of a blade tip comprising a fin 6 with a first side wall 9, a second side wall 10, and a cutting edge 18. FIG. 2*b* schematically shows a simplified example of the tensile stress distribution 19 in the first side wall 9 during operation.

Due to bending forces the tensile stresses are not constant in the cross section, leading to a local maximum in the tensile stress 19 as shown in FIG. 2*b*. The local maximum is higher then the average tensile stress 20 indicated for comparison.

In one embodiment the cutting edge 18 is solid. In another embodiment the cutting edge 18 comprises cooling and/or purge air holes.

In another embodiment the shroud 5 comprises several fins, which extend radially outwards parallel to each other, at least some being hollow, and light weight. Fins typically have pointed edges or sharp edges, which extended outwardly from the outer surface 15 of the shroud 5. The rotating blade 1 is cast as a single piece and the fin 6 is integrally molded and its dimension compared to airfoil 3 e.g. is typically less than one tenth.

To minimize local stress maxima the sidewalls 9, 10 can be contoured or curved to follow the line of force of the resulting forces, which act upon the fin 6 as shown in FIG. 3. For this, the first and second sidewall 9, 10 are spaced apart at the connection to the shroud 5, and are contoured to merge together at the end, which is radially away from shroud 5.

As indicated in FIG. 3, to allow for large cooling air or purge air supply cavity within the fin, the width of the fin 6 can be locally increased, using a supply widening 23 in the center region of the fin 6. This widening 23 can also serve to increase the stiffness as the maximum bending moments due to centrifugal forces occur in the center region of the fin and to reduce local stresses due to the force transition into the airfoil 3 of the blade.

FIG. 3*a*, schematically show a cross-section of a fin with curved first and second sidewall 9, 10, and a cutting edge 18. FIG. 3*b* shows the corresponding tensile stress distribution 19 in the sidewall 9. Ideally the local tensile stress 19 is constant and equal to the average tensile stress 20 in the sidewall.

In one embodiment, the first and second side wall 9, 10 are curved such that in operation the resulting line of force from the centrifugal forces and bending forces acting upon the cutting edge 18 and first and second side wall 9, 10 is oriented such that local maximum tensile stress is less than 1.3 times the average tensile stress. Preferably, the curvature is optimized to keep local maximum tensile stress below 1.1 times the average tensile stress.

In one embodiment the first and second side wall 9, 10 are curved such that the resulting line of force from the centrifugal forces and bending forces acting upon the cutting edge 18 and first and second side wall 9, 10 is oriented parallel to the curvature of the respective side wall 9, 10, during operation.

Figure 4:
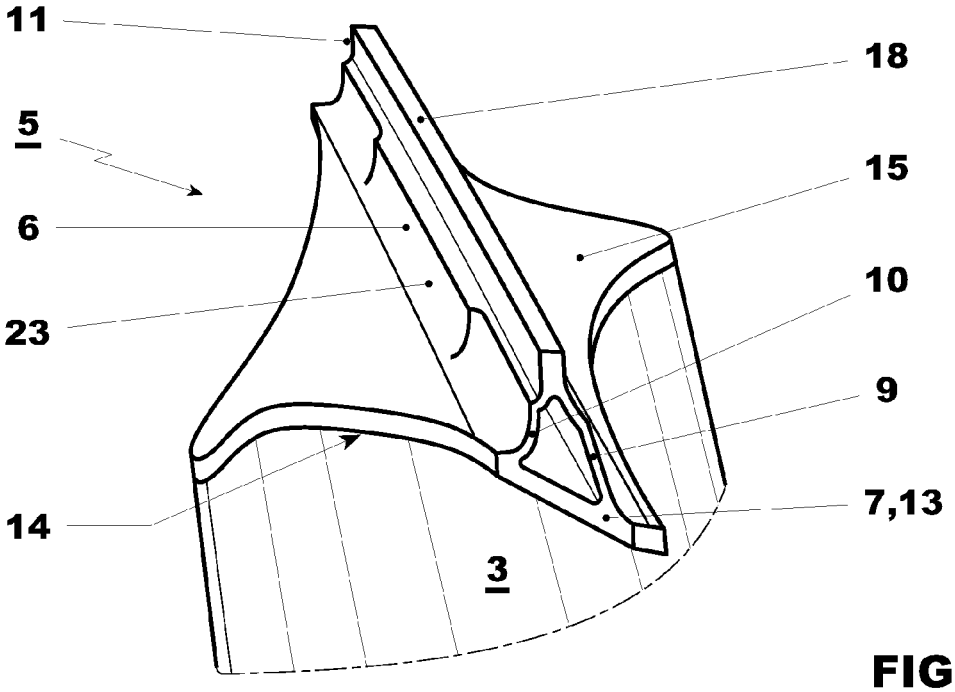

In reference to FIG. 4, a hole in an "aligned" shape has been realized. The aligned shaped hole extends from the fin's first end 13 along the length of fin 6 to its second end 11 in circumferential direction. An aligned shape in this context is a fin with basically constant wall thickness for the sidewalls 9, 10. The wall thickness remains constant in radial direction for at least 50% of the sidewall height. It can for example be constant for 80% or even more than 90% of the sidewall's 9, 10 height.

The fin 6 is made hollow by removing material around its neutral axis along the length of the fin 6 reducing the weight and making it hollow from the first end 13 or from second end 11 or both the ends.

Figure 5:
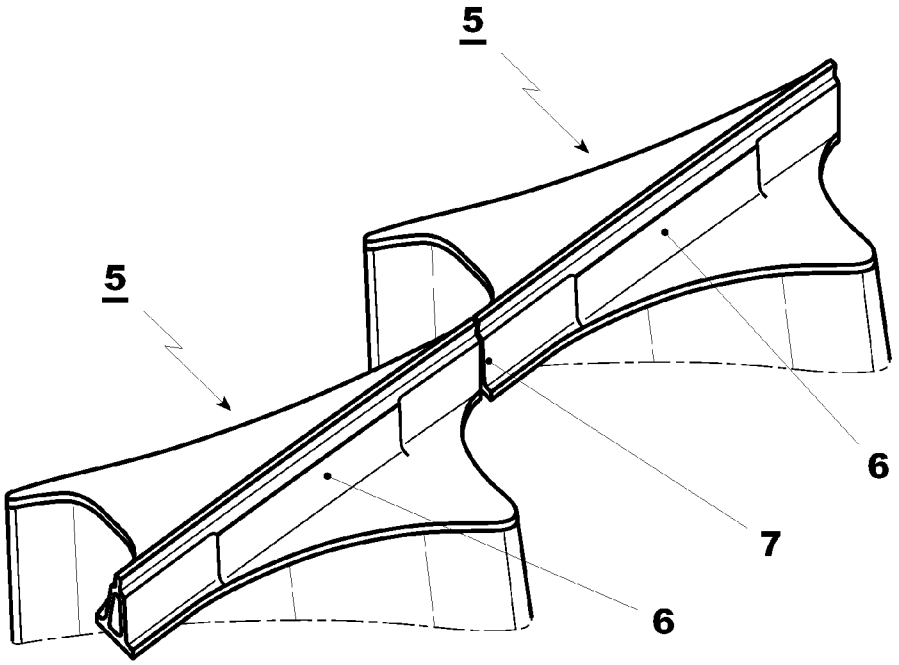

In FIG. 5 interlocking shrouds with hollow fins 6 are shown. The stiffness is sufficient to perform the interlocking task with the hollow fins 6. The weight removal around the neutral axis has negligible effect on stiffness or its effect is compensated by slightly larger outer dimension but its hollowness provides a great advantage due to weight reduction of the fin 6, and overall weight reduction of the rotating blade 1.

The hole in the fin 6 can extend form the first end 13 to the second end 11 of the fin.

Figure 6:
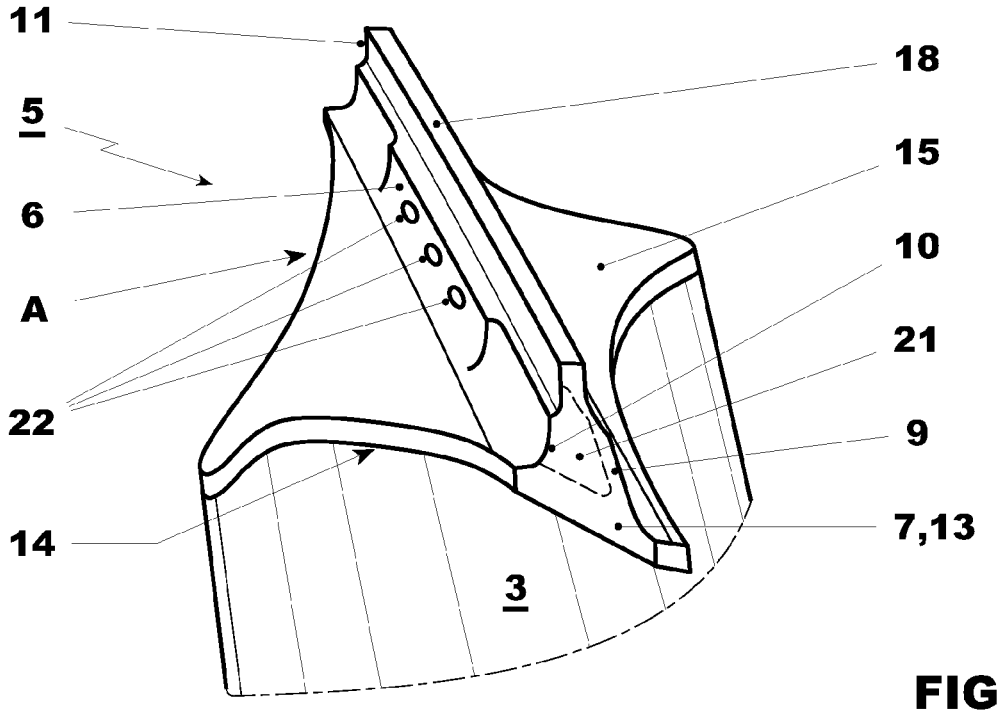

In a further embodiment shown in FIG. 6, an interlocking plate 21 closes the fin 6 at the first circumferential end 13 and/or the second circumferential end 11 of the fin 6.

Figure 7:
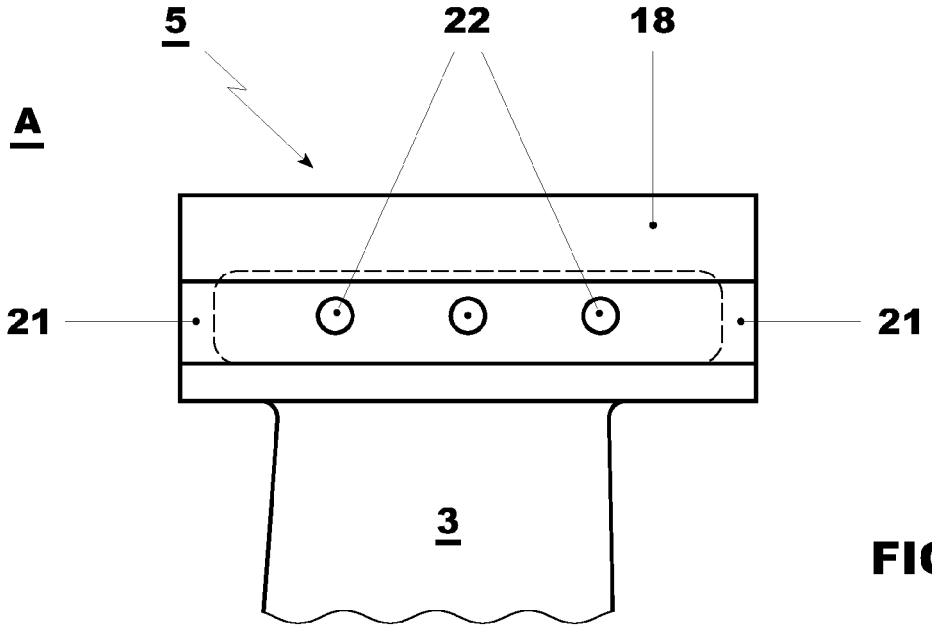

Further, as shown in FIGS. 6 and 7, cooling holes 22 can be provided at the side of at least one sidewall 9, 10. This is necessary to allow fin cooling.

In one embodiment, rotating blades 1 are manufactured by casting. The method includes shaping the rotating blade 1 in wax by enveloping a conventional alumina or silica based ceramic core.

In one embodiment the hollowness of fin can be achieved through water jets cutter, erosion, laser stream and through any such combination.

In one embodiment, rotating blades 1 are also manufactured by forging a single metal piece and hollowing fin 6 by machining.

The fin 6 on the shroud 5 is made hollow and lightweight without compromising on size and speed of rotation with sufficient axial section modulus leads to lighter blade 1 with high performance.

Typically, the neutral axis for bending of the fin is perpendicular to the centrifugal forces acting upon the fin when in operation.

The present invention is applicable for rear stages in particular for last stage blades. If necessary, to increase the interlock surface, the ends can be closed by a plate with different manufacturing methods like brazing, welding etc. By reducing the centrifugal forces the component life in creep regions will increase by a great extend.

Numerous modifications and adaptations of the present invention will be apparent to those skilled in the art and thus, it is intended by the following claims to cover all such modifications and adaptations which fall with in the scope of the invention.

It is understood, therefore, that this invention is not limited to the particular embodiments disclosed, but is intended to cover all modifications which are within the spirit and scope of the invention as defined by the appended claims; the above description; and/or shown in the attached drawings.

LIST OF REFERENCE SYMBOLS

1. Blade
2. Root
3. Airfoil
4. Platform
5. Shroud
6. Fin
7. Mating face
8. Rotor
9. First sidewall
10. Second sidewall
11. Second end
12. Neck area
13. First end
14. Inner surface
15. Outer surface
16. Machined surface
17. Platform sidewall
18. Cutting edge
19. Resulting local stress in side wall during operation
20. Average stress in side wall during operation
21. Interlocking plate
22. Cooling and/or purge air hole
23. Supply widening

What is claimed is:

1. A turbine blade comprising a tip end carrying a shroud and at least one fin, which extends radially away from the shroud, the fin comprises a first sidewall and a second sidewall, which are spaced apart from each other, and are connected to the shroud, and a cutting edge, which is connected to the first and second sidewalls, said cutting edge thereby creating a hollow space between the sidewalls, the shroud, and the cutting edge, and further extends radially away from the first and second sidewalls;

wherein the wall thickness of the first and second sidewalls are constant in a radial direction for at least 50% of the sidewall height.

2. The turbine blade according to claim 1, wherein first and second sidewalls are spaced apart at the connection to the shroud, and are contoured to merge together at the end, which is radially away from shroud.

3. The turbine blade according to claim 1, wherein the first and second sidewalls are contoured to seamlessly connect to the cutting edge.

4. The turbine blade according to claim 1, wherein the first and second sidewalls are curved such that in operation a resulting force from centrifugal forces and bending forces acting upon the cutting edge and first and second sidewalls lead to local maximum tensile stresses in the side walls, which are less than 1.3 times average tensile stresses in a cross section.

5. The turbine blade according to claim 1, wherein the first and second sidewalls are curved such that in operation a resulting line of force from centrifugal forces and bending forces acting upon the cutting edge and first and second sidewalls is oriented parallel to the curvature of the respective sidewall.

6. The turbine blade according to claim 1, wherein the hollow space is configured to guide cooling/purge air.

7. The turbine blade according to claim 1, wherein at least one cooling or purge air hole is provided in the cutting edge.

8. The turbine blade according to claim 1, wherein a neutral axis for bending of the fin is perpendicular to centrifugal forces acting upon the fin when in operation.

9. The turbine blade according to claim 1, wherein an interlocking plate closes the fin at a first and/or second circumferential end of the fin.

10. A method for manufacturing a turbine blade comprising a fin which extends radially away from a shroud, the fin comprises a first sidewall and a second sidewall, which are spaced apart from each other, and are connected to the shroud, and a cutting edge, which is connected to the first and second sidewalls, said cutting edge thereby creating a hollow space between the sidewalls, the shroud, and the cutting edge, and further extends radially away from the first and second sidewalls, the method comprising: casting the blade as single piece with the hollow fin;

wherein the hollow space is configured to guide cooling/purge air; and wherein the wall thickness of the first and second sidewalls are constant in a radial direction for at least 50% of the sidewall height.

11. A method for manufacturing a turbine blade comprising a fin which extends radially away from a shroud, the fin comprises a first sidewall and a second sidewall, which are spaced apart from each other, and are connected to the shroud, and a cutting edge, which is connected to the first and second sidewalls, said cutting edge thereby creating a hollow space between the sidewalls, the shroud, and the cutting edge, and further extends radially away from the first and second sidewalls, the method comprising:

forging the blade;

machining the fin to create the first and second sidewalls and cutting edge thereby opening the hollow space between said sidewalls and the cutting edge wherein the hollow space is configured to guide cooling/purge air; and wherein the wall thickness of the first and second sidewalls are constant in a radial direction for at least 50% of the sidewall height.

* * * * *